US007207353B2

(12) United States Patent
Bogdanowicz

(10) Patent No.: US 7,207,353 B2
(45) Date of Patent: Apr. 24, 2007

(54) PILOT CONTROLLED MULTIWAY VALVE

(75) Inventor: Grzegorz Bogdanowicz, Ostfildern (DE)

(73) Assignee: Festo AG & Co., Esslingen (DE)

( * ) Notice: Subject to any disclaimer, the term of this patent is extended or adjusted under 35 U.S.C. 154(b) by 106 days.

(21) Appl. No.: 10/946,300

(22) Filed: Sep. 21, 2004

(65) Prior Publication Data

US 2005/0067030 A1 Mar. 31, 2005

(30) Foreign Application Priority Data

Sep. 25, 2003 (DE) ..... 103 44 458

(51) Int. Cl.
*F15B 13/043* (2006.01)

(52) U.S. Cl. ..... 137/625.64

(58) Field of Classification Search ..... 137/625.64, 137/625.66

See application file for complete search history.

(56) References Cited

U.S. PATENT DOCUMENTS 3,516,441 A * 6/1970 McCormick ..... 137/625.61
3,902,526 A 9/1975 Brake et al.
4,067,357 A * 1/1978 Ruchser ..... 137/596.16
4,191,091 A * 3/1980 Zeuner et al. ..... 91/52
4,750,521 A * 6/1988 Teltscher ..... 137/625.66
4,754,693 A * 7/1988 Teltscher ..... 91/464
4,966,196 A 10/1990 Meyer
5,078,179 A * 1/1992 Amrhein ..... 137/625.69
5,129,425 A * 7/1992 Howarth et al. ..... 137/625.64
5,144,983 A * 9/1992 Schwelm ..... 137/625.64
5,273,074 A * 12/1993 Conradt et al. ..... 137/625.64
5,603,350 A 2/1997 Stoll et al.
5,775,374 A * 7/1998 Doi et al. ..... 137/625.64
5,913,577 A * 6/1999 Arndt ..... 303/117.1
5,924,440 A * 7/1999 Doi et al. ..... 137/270
5,996,628 A * 12/1999 Najmolhoda et al. .. 137/625.61
6,192,937 B1 2/2001 Fagerlie et al.

FOREIGN PATENT DOCUMENTS

DE 38 42 633 A1 6/1990
DE 19824664 A1 1/1999
DE 19937974 A1 3/2001

* cited by examiner

*Primary Examiner*—Eric Keasel
*Assistant Examiner*—Craig M. Schneider
(74) *Attorney, Agent, or Firm*—Hoffmann & Baron, LLP

(57) ABSTRACT

A multiway valve has valve housing and at least one pilot valve arranged in it. The principal valve housing possesses an integral principal housing part wherein at least the control section of a valve spool is arranged. The pilot valve possesses a head piece which is mounted on an assembly interface formed directly on the principal housing part. This assembly interface is furthermore provided with a pilot valve seat, which is an integral component of the principal housing part.

7 Claims, 1 Drawing Sheet

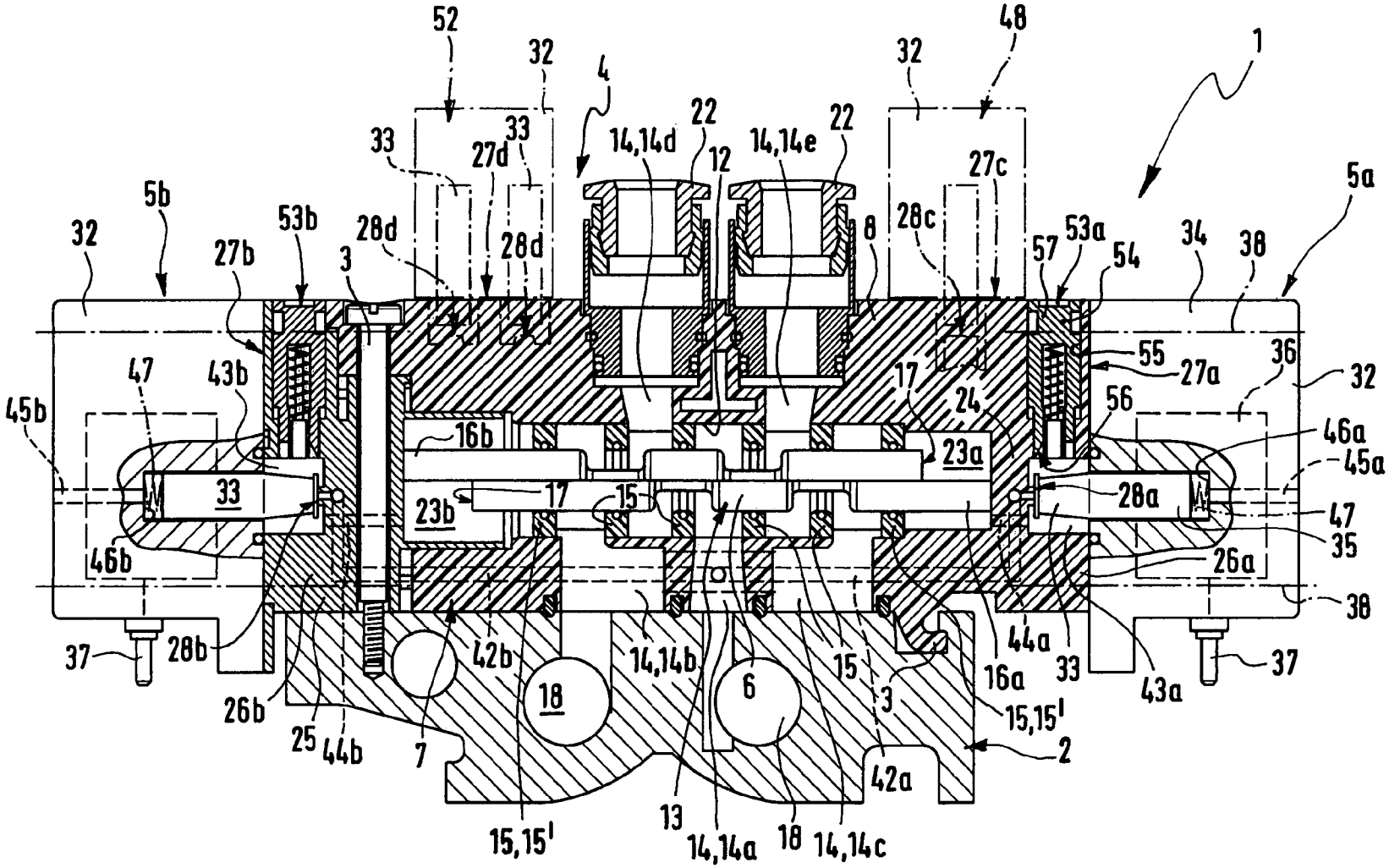
1
2
3
4
5a
5b
6
7
8
12
13
14,14a
14,14b
14,14c
14,14d
14,14e
15,15'
16a
16b
17
18
22
23a
23b
24
25
26a
26b
27a
27b
27c
27d
28a
28b
28c
28d
32
33
34
35
36
37
38
42a
42b
43a
43b
44a
44b
45a
45b
46a
46b
47
48
52
53a
53b
54
55
56
57

PILOT CONTROLLED MULTIWAY VALVE

BACKGROUND OF THE INVENTION

The invention relates to a pilot controlled multiway valve comprising a principal valve which has a principal valve housing and an elongated valve spool arranged in a spool receiving space of the same, the valve spool having a control section for controlling a connection between valve ducts opening laterally into the spool receiving space and, at one end at least, a drive section serving for controlled fluid action, the component of the spool receiving space, containing the control section, being located in an integral principal housing part of the valve housing, and furthermore comprising at least one pilot valve included with the principal valve in a subassembly for the control of fluid action on at least one drive section of the valve spool, which possesses a head piece mounted on an assembly interface fitted with a pilot valve seat and having an electrically operated pilot control member.

THE PRIOR ART

A multiway valve of this type disclosed in the U.S. Pat. No. 5,597,015 comprises a principal valve with a principal valve housing, which possesses a integral principal housing part containing the control section of the valve spool and two cover parts secured to opposite ends thereof. On one of such cover parts a pilot control valve is installed, which is composed of an intermediate plate on the cover part and a head piece secured to the intermediate plate. The intermediate plate defines an assembly interface and a pilot valve seat for a head piece of the pilot valve, which may be mounted on the assembly interface and has an electromagnetically operated pilot control member, which cooperates with the valve seat to control fluid action on a terminal drive section of the valve spool. The principal valve and the pilot valve are accordingly collected together as a subassembly, which is composed of a comparatively large number of components, something which entails a substantial amount of complexity for the production and assembly of the multiway valve.

A pressure limiting valve is disclosed in the German patent publication 4,110,926 C2, which possesses a valve housing with terminally fitted control valves. In the interior of the valve housing a sleeve-like valve insert is attached, on which the valve seats are formed which cooperate with valve members, which are acted upon by the control valves. The limiting valve is also relatively complex to manufacture.

SHORT SUMMARY OF THE INVENTION

One object of the present invention is to provide a pilot controlled multiway valve which may be manufactured more simply and more economically.

In order to achieve these and/or other objects appearing from the present specification, claims and drawings, in the present invention at least one assembly interface, including the associated pilot valve seat, is an integral component of the principal housing part of the principal valve housing, on which the head piece of the respective pilot valve is directly mounted.

This leads to a pilot controlled multiway valve with an enhanced degree of integration. The head piece of at least one pilot valve is now no longer installed with the intermediate placement of an additional intermediate plate on the principal housing part, but directly on an assembly interface formed directly on the principal housing part, the associated pilot valve seat being simultaneously provided on the principal housing part. There is accordingly no longer any need for the awkward fitting together of a large number of separate parts and furthermore costs of production may be reduced, because the pilot valve seat may be produced directly during the manufacture of the principal housing part. A more particularly significant advantageous configuration is provided if the principal housing part consists of plastic, since here there is the possibility, in the case of manufacture of the principal housing part by injection molding, of molding the assembly interface and the pilot valve seat associated with it directly in an integral fashion.

Further advantageous developments of the invention are defined in the claims.

Generally the principal housing part will have an elongated configuration. In this case at least one assembly interface with the associated pilot valve seat may be located on a long side of the principal housing part, such longitudinal side representing, during eventual later use of the multiway valve, more especially the top side of the valve. In order to have a slim structure together with a small overall height, however in most cases it will be more advantageous to provide the assembly interface with the pilot valve seat at an end of the principal housing part. This last mentioned design is more particularly advantageous, when the spool receiving space is sealed off at the end, which has the assembly interface, by a terminal wall section constituted by the integral principal housing part, i. e. the spool receiving space terminates at this end face practically like a blind hole in the interior of the principal housing part. Accordingly the entire outer end side of the principal housing part is available for the fitting of the head piece of the respective pilot valve.

In order, in the case of need, to provide for manual operation separate from the power supply of a pilot valve, the valve is preferably provided with a manual auxiliary operating means. In connection with a pilot valve, whose assembly interface and pilot valve seat are in the form of a component of the principal housing part, it is preferred to integrate the manual auxiliary operating means as well in the principal housing part. It is for example possible to arrange a setting member, able to be actuated from the outside, in a recess in the principal housing part.

The invention is applicable both in the case of multiway valves with only one pilot valve and also in the case of designs having two pilot valves. In the latter case there is the possibility of combining together the two pilot valves in a single pilot unit, which has a head piece with two pilot members and which is mounted on an assembly interface of the principal housing part, which is designed with two integrated valve seats.

In the case of the at least one electrically operated pilot valve it is more particularly a question of a solenoid valve. However, other configurations are possible, as for example in the form of a piezoelectric valve.

Further advantageous developments and convenient forms of the invention will be understood from the following detailed descriptive disclosure of one embodiment thereof illustrated in the single FIGURE of the accompanying drawings.

DETAILED ACCOUNT OF WORKING EXAMPLES OF THE INVENTION

The FIGURE shows a pilot controlled multiway valve generally referenced 1 and as an example as a component of a valve arrangement, which in addition includes at least one preferably plate-like fluid distributor or manifold 2, on which the multiway valve 1 is detachably secured using suitable attachment means 3.

The multiway valve 1 serves for controlling fluid flows, it more particularly being a question of compressed air. In principle however it may be a question of other gaseous or of hydraulic fluids.

The multiway valve 1 possesses a principal valve 4 which is part of a subassembly with at least one, and in the working example two, pilot valves 5*a* and 5*b*. The pilot valves 5*a* and 5*b* serve for control of fluid action on an elongated valve spool 6 of the principal valve 4 in order to shift same and to position it as desired.

The pilot valves 5*a* and 5*b* are electrically operated valves and in the working embodiment they are solenoid valves. In principle, however other types of valve would be possible as pilot valves, for example in the form of piezoelectric valves.

The principal valve 4 possesses a principal valve housing 7 having an elongated, integral principal housing part 8, wherein a spool receiving space 12 is formed extending in the longitudinal direction and occupying the control section 13, extending in the larger part of the length of the valve spool 6, of the latter. This control section 13 serves to control the connection between valve ducts 14 opening laterally in the spool receiving space because, dependent on its position, it connects or separates such valve ducts 14 in accordance with a particular pattern fluidwise. If the valve spool, as in the working embodiment, in the form of a piston spool, its control section 13 will comprise several length sections in axial succession having larger and smaller diameters. These sections cooperate with annular seal means 15 on the housing which are axially spaced apart in the spool receiving space 12 and divide up the same into a plurality of longitudinal sections, which are each connected with one of the valve ducts 14. If a length section with a large diameter of the control section 13 plunges into sealing means 15 concentrically, it will be surrounded by it with a sealing effect so that the length sections of the spool receiving space 12 on either side of the seal means 15 will be separated from one another. If on the other hand the length section with a smaller diameter of the control section 13 enters the a seal means 15 there will be an annular flow transfer section, which renders possible a flow transfer between the adjacent length sections of the spool receiving space 12 and the valve ducts connected with them.

At its two axial ends the valve spool 6 is provided with a drive section 16*a* and 16*b* which respectively renders possible a controlled fluid action. For this purpose each drive section 16*a* and 16*b* has an end face 17 able to be acted upon by the fluid. In the working embodiment the two drive sections 16*a* and 16*b* are integrally connected with the control section 13, the entire valve spool 6 being an integral structure. There is furthermore a provision such that the diameter of the drive sections 16*a* and 16*b* is the same as the diameter of the length sections with the larger diameter of the control section 13. However, it would readily be possible to design the drive sections 16*a* and 16*b* as components separate from the control section 13. Moreover, there is the possibility of designing the drive sections 16*a* and 16*b* like pistons with an external diameter larger than the external diameter of the length sections with a larger diameter of the control section 13.

The fluid action on the drive sections 16*a* and 16*b* is respectively controlled by one of the two pilot valves 5*a* and 5*b*. Accordingly the valve spool 6 may be shifted in opposite directions along its longitudinal axis and positioned as required. In the working embodiment the multiway valve 1 has a 4/2 valve functionality.

It would be possible to design the multiway valve 1 with only one pilot valve 5*a*, if other means, for example a spring means, can ensure return of the valve spool 6 into its home position.

The valve ducts 14 include a supply duct 14*a*, which is flanked on either side by a respective venting duct 14*b* and 14*c*. These ducts communicate with distributing ducts 18 extending in the fluid distributor 2, and by way of which the pressure medium is supplied and removed. In the working embodiment the two venting ducts 14*b* and 14*c* are connected with each other within the principal housing part 8 so that the same communicate jointly with a single fluid distributor duct 18.

Two further valve ducts 14 are in the form of power ducts 14*d* and 14*e* and open for example at the top side, opposite to the fluid distributor 2, of the principal housing part 8. Here they are provided with connection means 22, which render possible a more particularly detachable connection of fluid lines, which need to be operated, as for example a drive actuated by fluid force.

The principal valve 4 is so designed in the working example that not only the control section 13 but also the drive sections 16*a* and 16*b* and accordingly the entire valve spool 6 is within the integral principal housing part 8. The valve spool 6 has its the drive sections 16*a* and 16*b*, running respectively in a terminal section 23*a* and 23*b* of the spool receiving space 12, which is separated from the central part of the spool receiving space 12 by external sealing means 15', the control section 13 being located in such spool receiving space.

In the working embodiment the spool receiving space 12 is sealed off by a terminal wall section 24, on the right in the drawing, of the principal housing part 8. The terminal wall section 24 is accordingly a component of the principal housing part 8 peripherally surrounding the spool receiving space 12. At the opposite second terminal side of the principal housing part 8 on the other hand the spool receiving space is not delimited by the principal housing part 8 so that it is all in all formed like a blind hole in the principal housing part 8. Its longitudinal axis runs parallel to the longitudinal axis of the principal housing part 8.

At the second terminal side the spool receiving space 12 is closed off by a separate cover part 25 of the principal valve housing 7 with a sealing action and more particularly detachably. The cover part 25 can, as illustrated, extend a little into the principal housing part 8 axially.

The first pilot valve 5*a* arranged at the first terminal side of the spool receiving space 12 is partially formed as part of a subassembly with the principal housing part 8 of the principal valve housing 7. Thus the first pilot valve 5*a* comprises a floor part 26*a*, which is formed by the terminal section, defining the terminal wall section 24, of the principal housing part 8. On this floor part 26*a*, i. e. on the terminal side of the principal housing part 8, an assembly interface 27*a* is formed, which has a pilot valve seat 28*a* made integrally with the principal housing part 8. The latter is preferably placed so that it is somewhat sunk into the principal housing part 8.

In addition to the floor part 26*a* the first pilot valve 5*a* possesses a head piece 32, which has a movable pilot control member 33, which extends somewhat from the housing, termed herein the pilot control housing 34, of the head piece 32. The pilot control member 32 is, in the working example, constituted by a moving magnet armature 35 or is kinematically coupled with it, such armature being provided with at least one magnet coil or solenoid 36, arranged in the pilot control housing 34, and able to be excited by way of externally accessible electrical contact means 37 by an exciting voltage.

The head piece 32 is mounted on the assembly interface 27*a*, the pilot control housing 34 directly engaging the terminal side of the principal housing part 8 and the pilot control member 33 assuming a position opposite to the pilot valve seat 28*a*. The attachment on the principal valve housing 7 is for example effected by means of attachment screws 38, indicated in chained lines, or by some other attachment means.

In the working embodiment the principal housing part 8 comprises plastic material, which if necessary may be reinforced by fibers or other elements. It is produced by casting and more particularly by injection molding. In the case of this form of manufacture the pilot valve seat 28*a* may be directly produced as a component which is made in one piece with the principal housing part 8. Such an integral design of the principal housing part 8 and of the pilot valve seat 28*a* is however also readily possible in the case of a metallic design.

The pilot valve seat 28*a* delimits the opening of a pilot supply duct 42*a* supplying pressure medium for the actuation of the valve spool 6 as necessary. In the working embodiment it branches off for this purpose inside the principal housing part 8 for the supply duct 14*a*.

The pilot valve seat 28*a* is located in a valve chamber 43*a*, defined within a terminal recess in the principal housing part 8, the pilot control member 33 extending into such valve chamber 43*a*. A pilot control power duct 44*a* extends from such chamber 43*a* and extends through the wall of the principal housing part 8 to then open into the first terminal section 23*a* of the spool receiving space 12.

Finally there is a pilot venting duct 45*a*, which—more particularly extending past the pilot control member 33—connects the valve chamber 43*a* with the surroundings, and has a venting valve seat 46*a* placed opposite to the rear side of the pilot control member 33.

Accordingly the first pilot valve 5*a* may be operated with a 3/2 valve functionality. In the electrically deactivated state the pilot control member 33 is subject to the action of a diagrammatically indicated spring 47 on the pilot valve seat 28*a* and seals off the pilot control supply duct 42. Simultaneously the terminal section 23*a* is vented off to the surrounding by way of the pilot control power duct 44*a* and the pilot venting duct 45*a*. Given suitable actuation of the second pilot valve 5*b* the valve spool 6 may be shifted to the right in the drawing into the first switching position indicated underneath the center line. For switching over the valve spool 6 to the left second switching position indicated in the drawing above the center line the first pilot valve 5*a* is activated by the application of an exciting voltage so that the pilot control member 33 clears the seat 28 and simultaneously engages the venting valve seat 46*a*. Now the pressure medium may flow from the pilot control supply duct 42*a* by way of the pilot control power duct 44*a* into the adjacent terminal section 23*a* of the spool receiving space 12 and act upon the first drive section 16*a* as a thrust force.

The second pilot valve 5*b* provided for the second terminal side of the spool receiving space 12 has the same design as the first pilot valve 5*a* with one exception. In the case of the corresponding components the reference letter "a" has been replaced by the reference letter "b". In other respects the description of functions in relation to the first pilot valve 5*a* applies to the second pilot valve 5*b*.

The essential difference between the two pilot valves 5*a* and 5*b* is that in the case of the second pilot valve 5*b* the floor part 26*b* is not an integral component of the principal housing part 8, but is constituted by the cover part 25 designed separately from the principal housing part 8. Accordingly in the case of the second pilot valve 5*b* the assembly interface 27*b* and the pilot valve seat 28*b* are also arranged on the cover part 25. The manner of functioning of the two pilot valves 5*a* and 5*b* is identical so that the valve spool 6 may be selectively shifted in the one or the other direction by matched actuating and venting of the terminal sections 23*a* and 23*b* of the spool receiving space 12.

Because the floor part 26*b* is constituted by the cover part 25 in the case of the second pilot valve 5*b*, simple separation from the principal housing part 25 is possible so that the open terminal face of the spool receiving space 12 is accessible in order to install the valve spool 6 and the sealing means 15 and if necessary remove same.

In the working embodiment the first pilot valve 5*a* is so designed and arranged that its pilot valve seat 28*a* assumes a position in an axial extension of the spool receiving space 12. Such a design is readily possible if the spool receiving space 12 is sealed at the first terminal side directly by the principal housing part 8. However, it would be possible in principle for the first pilot valve 5*a* to be so placed at the terminal side of the principal housing part 8 that the zone in an extension of the spool receiving space 12 is not occupied so that at such terminal side a removable cover may be provided for the spool receiving space 12. This cover would not however have any function as regards the first pilot valve 5*a*.

In the drawing chained lines at 48 serve to indicate that at least one pilot valve 48 may be placed on the longitudinal side on the principal valve 4 if desired, that is to say more especially on the top side of the principal valve housing 7. In accordance with the basic principle of the invention an assembly interface 27*c* and at least one associated pilot valve seat 28*c* is arranged as an integral component of the principal housing part 8 on the longitudinal side of the principal housing part 8 and is fitted with a head piece 32 of the respective pilot valve 48. Dependent on the particular design it is possible as required to provide one or two pilot valves in a corresponding manner on the longitudinal side of the principal housing part 8.

If the multiway valve 1 possesses two pilot valves there is also the possibility of combining same together as one pilot control unit as is indicated in chained lines in the drawing at 52. In this case an assembly interface 27*d* provided on the principal housing part 8 has two pilot valve seats 28*d* for it, which are integrated in the principal housing part 8, the mounted head piece 32 of the pilot control unit 52 respectively comprising two pilot control members 33 associated with one of the pilot valve seats 28*d*.

Reverting to the first and second pilot valves 5*a* and 5*b* as explained it is also to be noted that same are each additionally provided with a manual auxiliary operating means 53*a* and 53*b*. Such means is respectively integrated in the associated floor part 26*a* and 26*b*. In the case of the first pilot valve 5*a* this means that the manual auxiliary operating means 53*a* is installed in the principal housing part 8 and accordingly is located in the same component which constitutes the assembly interface 27*a* and the pilot valve seat 28*a* of the associated first pilot valve 5*a*.

In the case of the second pilot valve 5*b* the manual auxiliary operating means 53*b* is preferably arranged in the cover part 25.

In both cases the manual auxiliary operating means 53*a* and 53*b* may have a preferably plunger-like setting member 54, which slides in a recess 55, aligned athwart the longitudinal direction of the pilot control member 33, of the floor part 26*a* and 26*b*, such recess 55 opening at one end to the outer side of the floor part 26 and at the other end into the valve chamber 43. At the front end facing the valve chamber 43 the setting member 54 possesses a preferably oblique face as a driving region 56 which fits underneath the associated pilot control member 33 and is lifted from the associated pilot valve seat 28*a* and 28*b*, when the setting member 54 is shifted toward the pilot control member 33

The shifting of the setting member 54 may be caused manually. For this purpose the setting member 54 has an actuating portion 57 accessible from the outside.

The invention claimed is:

1. A pilot controlled multiway valve comprising:

an elongated principal valve housing having an integral wall section at one end thereof, a removable cover part at an opposite end thereof, a longitudinal spool receiving space formed therein and terminating at one end at said wall section and terminating at an opposite end at said cover part, a first pilot valve recess formed in said integral wall section axially parallel with said spool receiving space, a second pilot valve recess formed in said cover part opposite said first pilot valve recess and axially parallel with said spool receiving space, a first auxiliary operating member recess formed in said wall section perpendicular to said first pilot valve recess and said spool receiving space, a second auxiliary operating member recess formed in said cover part perpendicular to said second pilot valve recess and said spool receiving space, a first assembly interface disposed on an outer surface of said wall section surrounding said first pilot valve recess, a second assembly interface disposed on an outer surface of said cover part surrounding said second pilot valve recess, a first valve seat formed integrally with a bottom of said first pilot valve recess, a second valve seat formed integrally with a bottom of said second pilot valve recess and a plurality of valve ducts opening laterally into said spool receiving space;

a valve spool slidably received in said spool receiving space, said valve spool having a control section for controlling a connection between said valve ducts and a drive section disposed at an end thereof adjacent said wall section;

a first pilot valve for controlling fluid action on said valve spool drive section, said first pilot valve including a head piece mounted on said first assembly interface of said valve housing wall section and an electrically operated pilot control member engaging said first integral valve seat;

a second pilot valve disposed coaxially opposite said first pilot valve for controlling fluid action on said valve spool drive section, said second pilot valve including a head piece mounted on said second assembly interface of said valve housing cover part and an electrically operated pilot control member engaging said second integral valve seat;

a first auxiliary operating member for manually disengaging said first pilot control member from said first integral valve seat, said first manual auxiliary operating member being received in said first auxiliary operating member recess of said valve housing wall section; and a second manual auxiliary operating member for manually disengaging said second pilot control member from said second integral valve seat, said second manual auxiliary operating member being received in said second auxiliary operating member recess of said valve housing cover part.

2. A pilot controlled multiway valve as defined in claim 1, wherein the principal valve housing is made from a plastic material.

3. A pilot controlled multiway valve as defined in claim 1, wherein the first and second manual auxiliary operating members are each arranged to be manually set from outside the valve housing.

4. A pilot controlled multiway valve as defined in claim 1, wherein the valve spool has a fluid driven drive section at both ends thereof.

5. A pilot controlled multiway valve as defined in claim 1, wherein at least one of the first and second pilot valves is a solenoid valve.

6. A pilot controlled multiway valve as defined in claim 1, wherein the drive section of the valve spool is integrally connected with the control section.

7. A pilot controlled multiway valve as defined in claim 1, wherein the full length of the valve spool is arranged within the principal valve housing.

* * * * *